US006758702B2

(12) United States Patent
Johnescu

(10) Patent No.: US 6,758,702 B2
(45) Date of Patent: Jul. 6, 2004

(54) ELECTRICAL CONNECTOR WITH COMPRESSION CONTACTS

(75) Inventor: Douglas Michael Johnescu, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/783,375

(22) Filed: Feb. 14, 2001

(65) Prior Publication Data

US 2001/0049206 A1 Dec. 6, 2001

Related U.S. Application Data

(60) Provisional application No. 60/184,607, filed on Feb. 24, 2000.

(51) Int. Cl.[7] ..... H01R 4/48

(52) U.S. Cl. ..... 439/862; 439/66

(58) Field of Search ..... 439/66, 74, 41, 439/629, 630, 733, 862

(56) References Cited

U.S. PATENT DOCUMENTS

| | | | | | |
|---|---|---|---|---|---|
| 4,220,383 | A | * | 9/1980 | Scheingold et al. | 439/71 |
| 4,354,729 | A | * | 10/1982 | Grabbe et al. | 439/733.1 |
| 4,370,017 | A | * | 1/1983 | Grabbe et al. | 439/862 |
| 4,936,792 | A | * | 6/1990 | Onoue et al. | |
| 5,139,427 | A | | 8/1992 | Boyd et al. | 439/66 |
| 5,259,769 | A | * | 11/1993 | Cruise et al. | 439/65 |
| 5,306,163 | A | | 4/1994 | Asakawa | 439/74 |
| 5,338,231 | A | * | 8/1994 | Wilhite | 439/660 |
| 5,484,295 | A | | 1/1996 | Mowry et al. | 439/66 |
| 5,653,598 | A | | 8/1997 | Grabbe | 439/66 |
| 5,655,913 | A | | 8/1997 | Castaneda et al. | 439/66 |
| 5,746,608 | A | * | 5/1998 | Taylor | 439/70 |
| 5,746,626 | A | * | 5/1998 | Kwiat et al. | 439/630 |
| 5,772,449 | A | | 6/1998 | Feldmeier et al. | 439/66 |
| 5,800,184 | A | | 9/1998 | Lopergolo et al. | 439/66 |
| 5,810,609 | A | | 9/1998 | Faraci et al. | 439/71 |
| 5,829,988 | A | | 11/1998 | McMillan et al. | 439/70 |
| 5,863,210 | A | * | 1/1999 | Reisinger | 439/41 |
| 5,879,169 | A | | 3/1999 | Wu | 439/74 |
| 5,885,090 | A | * | 3/1999 | Comstock et al. | 439/65 |
| 5,891,591 | A | * | 4/1999 | Suzuki | 429/178 |
| 5,899,760 | A | | 5/1999 | Ho et al. | 439/135 |
| 5,938,451 | A | | 8/1999 | Rathburn | 439/66 |
| 5,951,303 | A | | 9/1999 | Wilmsmann nee Sudmoller | 439/66 |

(List continued on next page.)

FOREIGN PATENT DOCUMENTS

| | | |
|---|---|---|
| EP | 0 568 971 A | 11/1993 |
| WO | WO 98/15989 | 4/1998 |

*Primary Examiner*—Tho D. Ta
*Assistant Examiner*—Larisa Tsukerman
(74) *Attorney, Agent, or Firm*—Woodcock Washburn LLP

(57) ABSTRACT

An electrical connector comprises a housing having a retention structure, and a plurality of contacts extending through said housing. Each contact has a medial section, a mounting portion extending from one end of the medial section, and a compressive mating portion extending from another end of the medial section and having a distal end. The retention structure of the housing engages the distal ends of the compressive mating portions of the contacts to preload the contacts. The contacts extend through the housing and exhibit a preload. A fusible element is secured to each respective one of the contacts.

4 Claims, 15 Drawing Sheets

U.S. PATENT DOCUMENTS 5,967,800 A * 10/1999 Bishop ..... 439/74
5,975,914 A 11/1999 Uchida ..... 439/66
5,980,268 A * 11/1999 Mischenko ..... 439/66
5,980,323 A * 11/1999 Bricaud et al. ..... 439/630
5,989,049 A * 11/1999 Walkup et al. ..... 439/342
6,000,969 A 12/1999 Reichardt et al. ..... 439/630
6,022,224 A 2/2000 Peters ..... 439/66
6,024,584 A * 2/2000 Lemke et al.
6,068,514 A * 5/2000 Zuin ..... 439/630
6,077,089 A * 6/2000 Bishop et al. ..... 439/66
6,155,844 A * 12/2000 Semmeling et al. ..... 439/65
6,155,860 A * 12/2000 Lemke et al. ..... 439/341
6,193,523 B1 * 2/2001 Harper, Jr. ..... 439/66
6,241,535 B1 * 6/2001 Lemke et al. ..... 439/83
6,241,558 B1 * 6/2001 Mosquera ..... 439/660
6,315,620 B1 * 11/2001 Moie et al. ..... 439/862
6,325,644 B1 * 12/2001 Lemke et al. ..... 439/83
6,352,437 B1 * 3/2002 Tate ..... 439/83
6,361,345 B1 * 3/2002 Tan ..... 439/342
6,386,889 B1 * 5/2002 Bishop ..... 439/66
6,579,104 B1 * 6/2003 Bishop et al. ..... 439/66

* cited by examiner

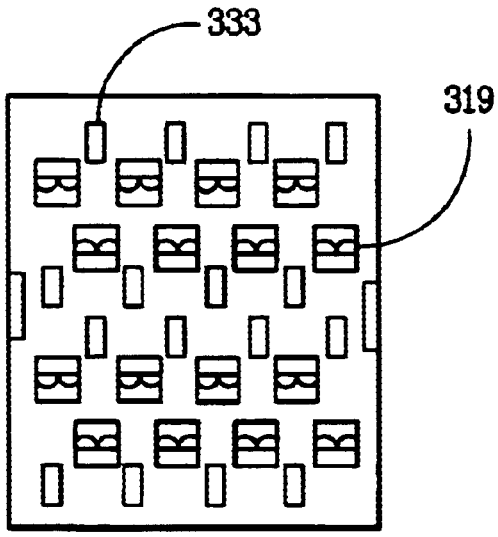
FIG. 26
FIG. 27
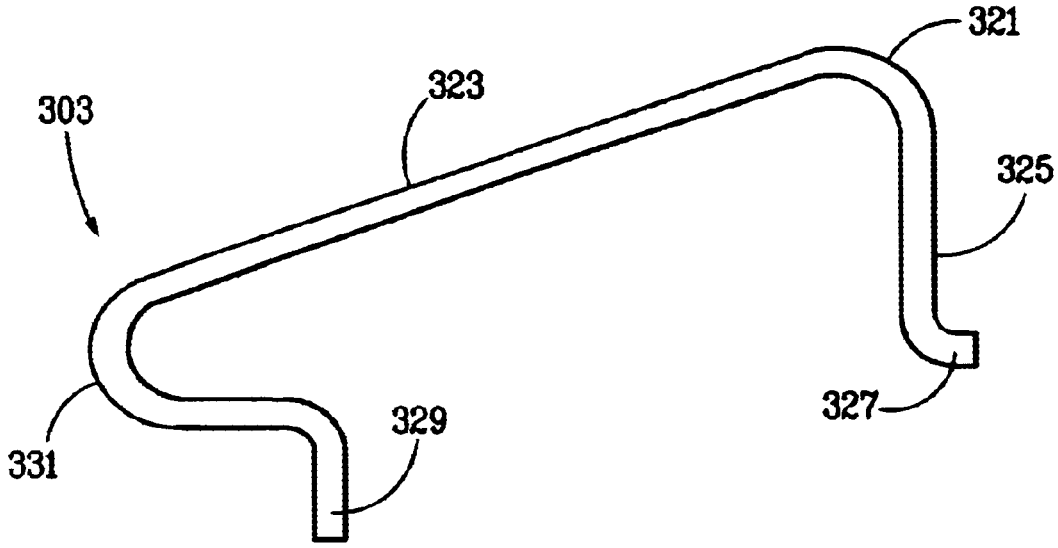

ELECTRICAL CONNECTOR WITH COMPRESSION CONTACTS

RELATED APPLICATION DATA

This application claims the benefit of U.S. Provisional Application Ser. No. 60/184,607, which was filed on Feb. 24, 2000, herein incorporated by reference.

BACKGROUND OF THE INVENTION

1. Field of the Invention

The present invention relates to electrical connectors. More specifically, the present invention relates to mezzanine-style electrical connectors using compression contacts to interconnect a first electrical component to a second electrical component.

2. Brief Description of Earlier Developments

U.S. Pat. No. 5,484,295 describes a typical compression connector. Typical compression connectors have contacts with medial sections retained within a housing. Depending upon the application, the contact has at least one arm extending from the medial section in cantilevered fashion to engage an electrical component. Such connectors may not provide suitable wiping action or contact normal force.

SUMMARY OF THE INVENTION

It is an object of the present invention to provide an electrical connector with suitable wiping action.

It is a further object of the present invention to provide an electrical connector with suitable contact normal force.

It is a further object of the present invention to provide a surface mounted compression connector.

It is a further object of the present invention to provide a compression connector with preloaded contacts.

These and other objects of the present invention are achieved in one aspect of the present invention by an electrical connector, comprising: a housing having a retention structure; and a plurality of contacts extending through the housing. Each contact has: a medial section; a mounting portion extending from one end of the medial section; and a compressive mating portion extending from another end of the medial section and having a distal end. The retention structure of the housing engages the distal ends of the compressive mating portions of the contacts to preload the contacts.

These and other objects of the present invention are achieved in another aspect of the present invention by an electrical connector, comprising: a housing; a plurality of contacts extending through the housing and exhibiting a preload; and a plurality of fusible elements, each secured to a respective one of the contacts.

These and other objects of the present invention are achieved in another aspect of the present invention by a method of making an electrical connector, comprising the steps of: providing a housing; inserting a plurality of contacts into the housing; securing a fusible element to each contact; and preloading the contacts.

BRIEF DESCRIPTION OF THE DRAWINGS

Other uses and advantages of the present invention will become apparent to those skilled in the art upon reference to the specification and the drawings, in which:

FIG. 26 is a bottom view of the electrical connector shown in FIG. 18;

FIG. 27 is a side view of a contact, which is one component of the electrical connector shown in FIG. 18;

DETAILED DESCRIPTION OF THE PREFERRED EMBODIMENTS

Figure 1:
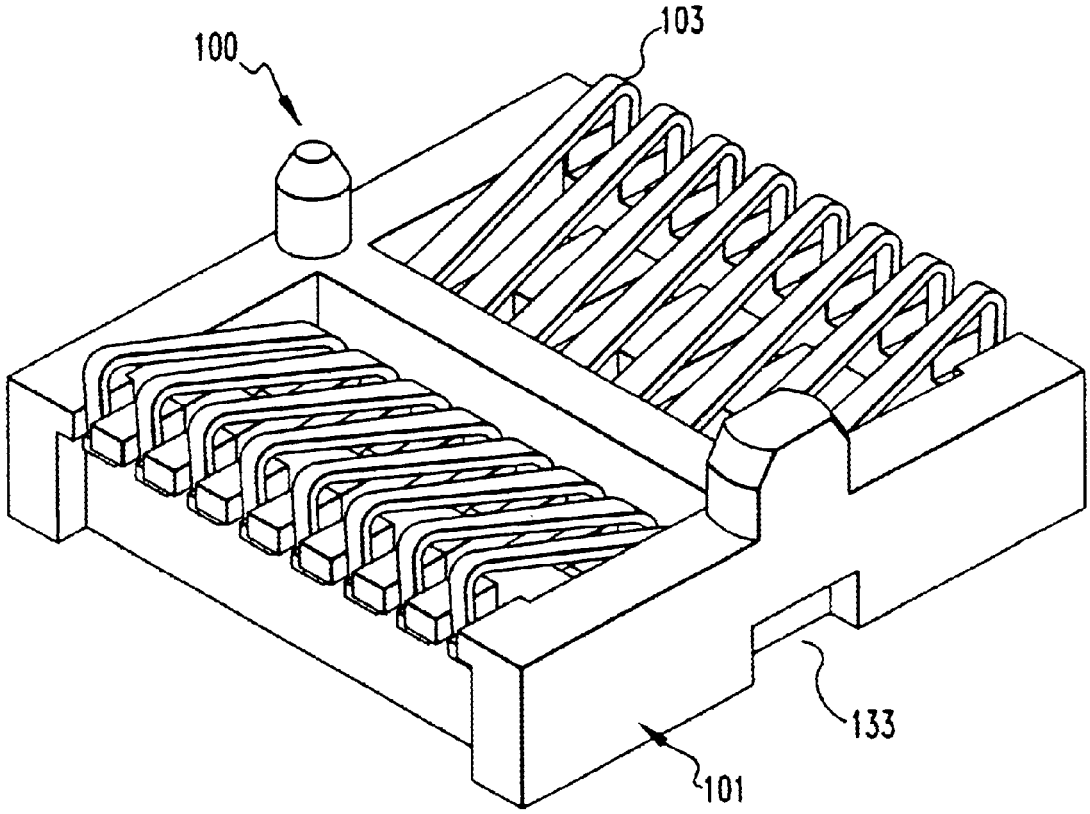
FIG. 1 is a perspective view of a first alternative embodiment of an electrical connector of the present invention.
Figure 2:
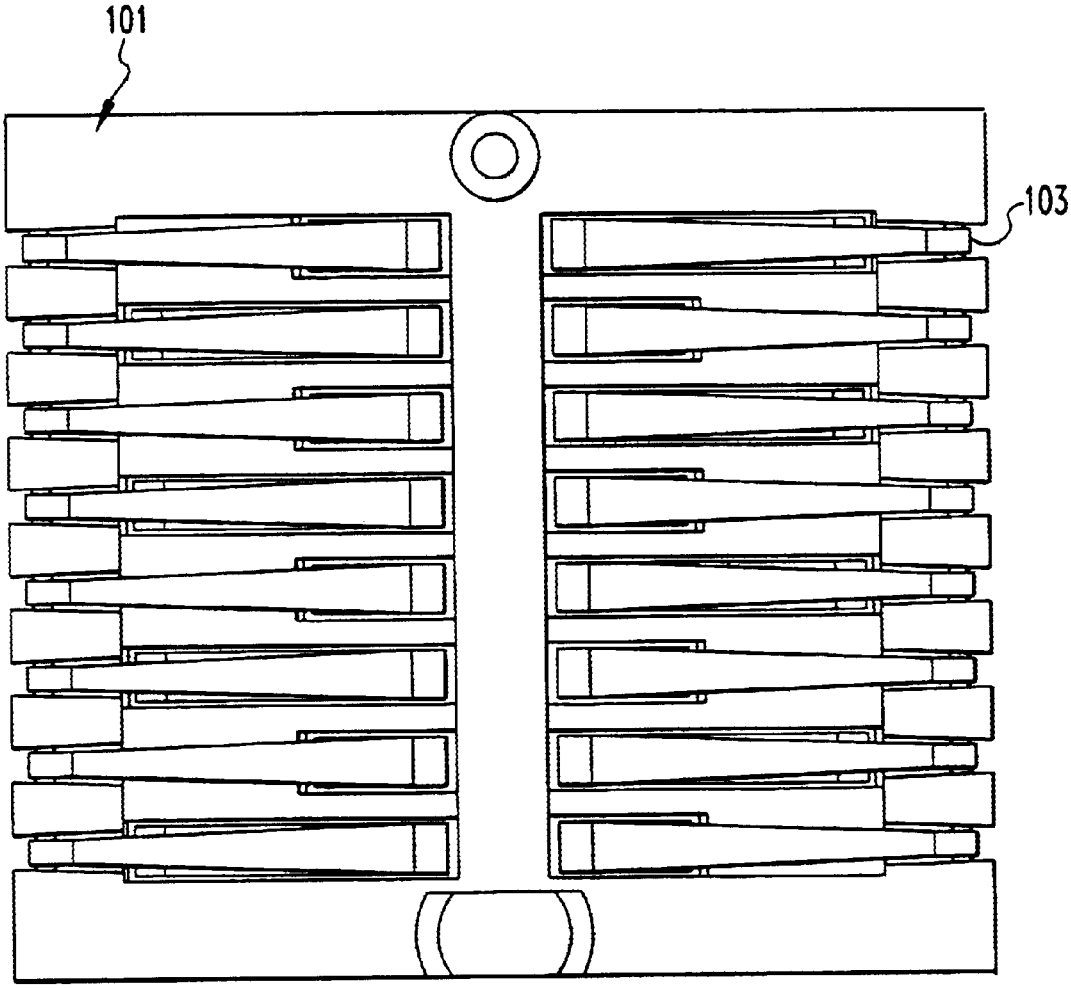
FIG. 2 is a top view of the electrical connector shown in FIG. 1.
Figure 3:
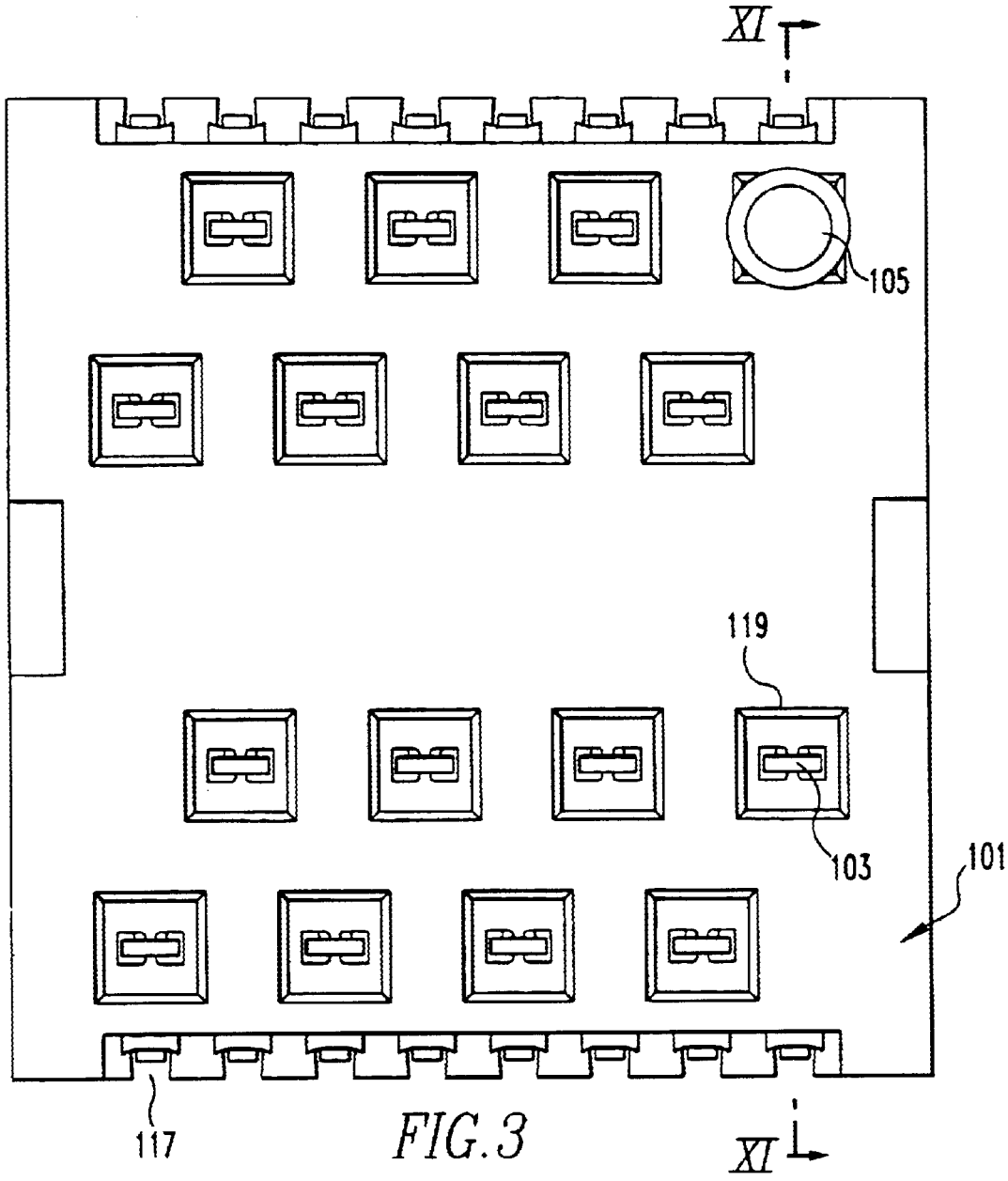
FIG. 3 is a bottom view of the electrical connector shown in FIG. 1 with one fusible element secured to a contact.

FIGS. 1–5 display one alternative embodiment of the present invention. Specifically, FIG. 1 shows a perspective view of an electrical connector 100, FIG. 2 shows a top view of the connector 100, and FIG. 3 shows a bottom view of the connector 100. Connector 100 comprises a housing 101, contacts 103, and fusible elements 105, described in further detail below.

Figure 4:
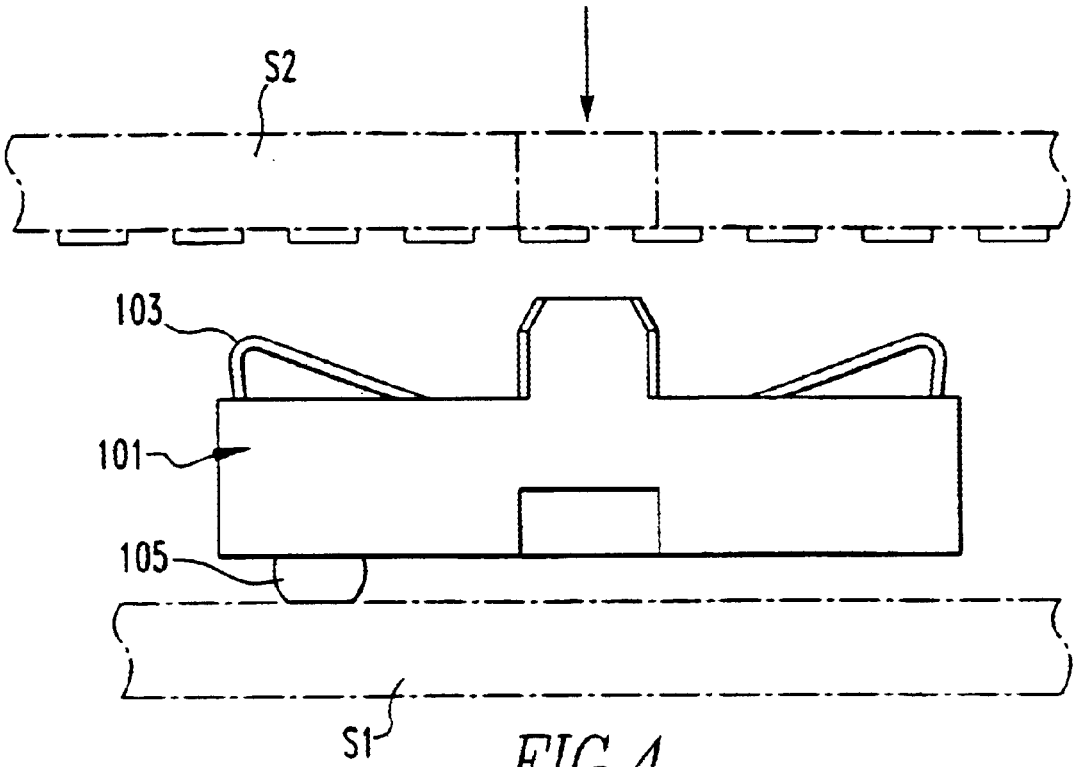
FIG. 4 is a side view of the electrical connector shown in FIG. 1 with one fusible element secured to a contact.
Figure 5:
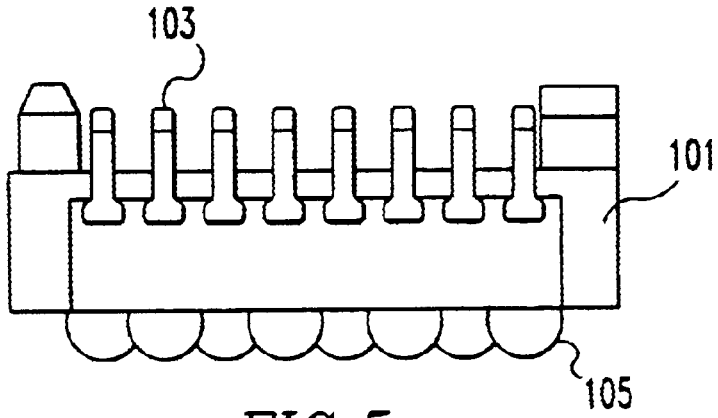
FIG. 5 is a front view of the electrical connector shown in FIG. 1 with fusible elements secured to all of the contacts.

A side view of the electrical connector 100 with one fusible element 105 secured to a contact 103 is shown in FIG. 4, and FIG. 5 is a front view of the electrical connector 100 with fusible elements 105 secured to all of the contacts 103. Connector 100 preferably surface mounts to a first substrate S1 and engages a second substrate S2. Substrates S1, S2 could be, for example, printed circuit boards (PCBs) or land grid arrays (LGAs).

Figure 6:
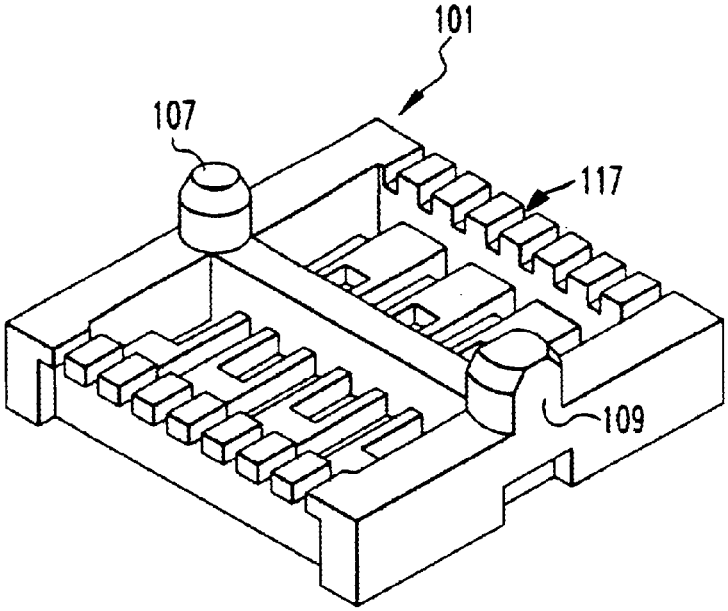
FIG. 6 is a perspective view of a housing, which is one component of the electrical connector shown in FIG. 1.
Figure 7:
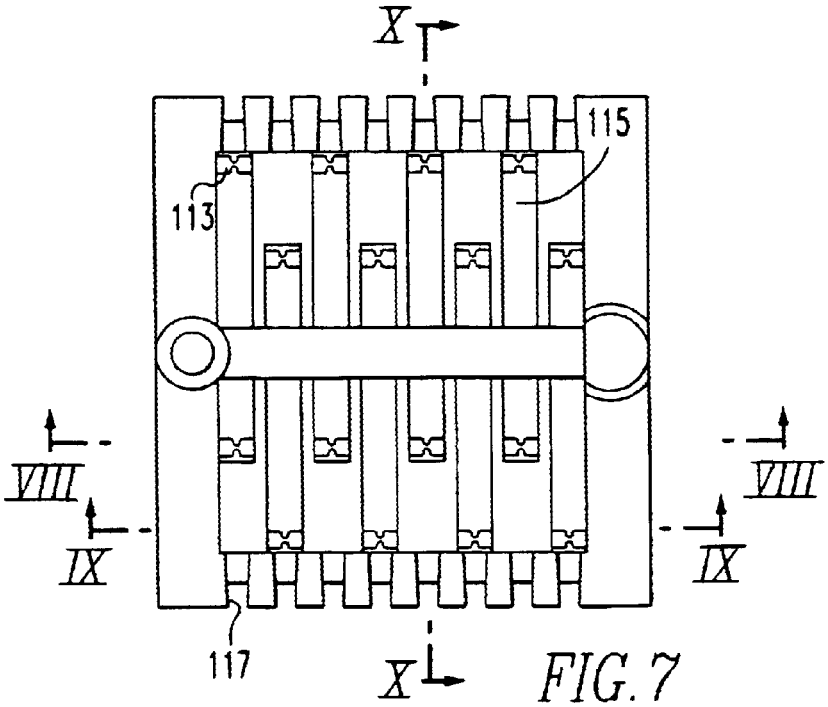
FIG. 7 is a top view of the housing shown in FIG. 6.
Figure 8:
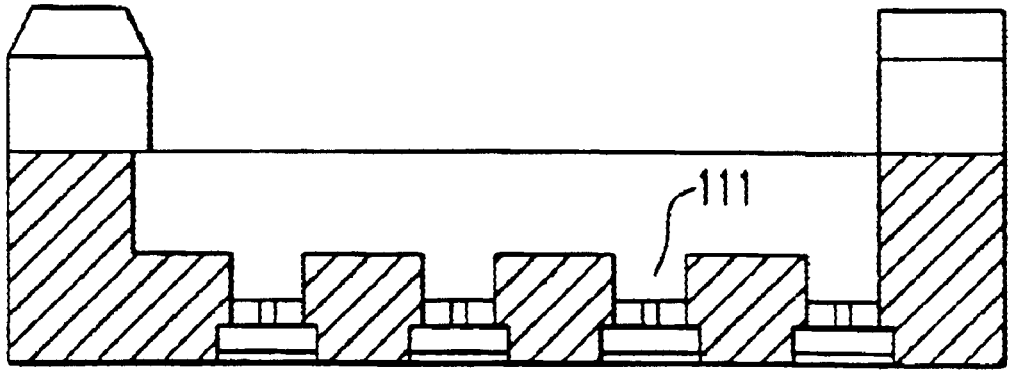
FIG. 8 is a cross-sectional view of the housing taken along line VIII—VIII in FIG. 7.
Figure 9:
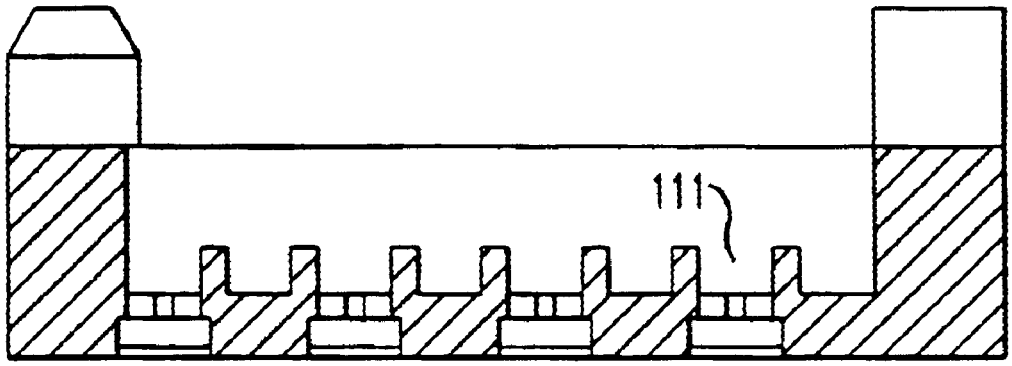
FIG. 9 is a cross-sectional view of the housing taken along line IX—IX in FIG. 7.
Figure 10:
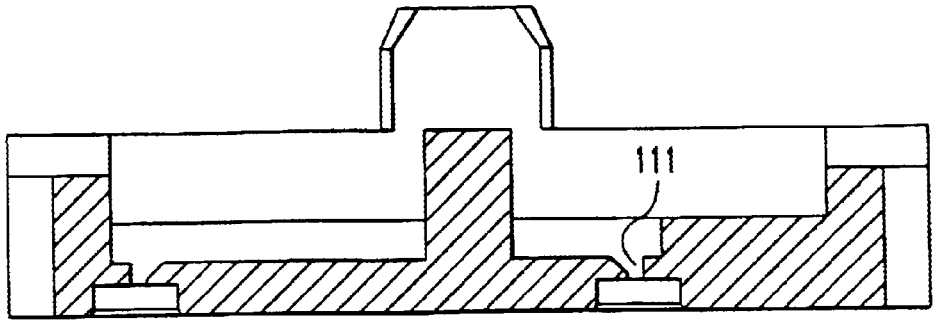
FIG. 10 is a cross-sectional view of the housing taken along line X—X in FIG. 7.
Figure 11:
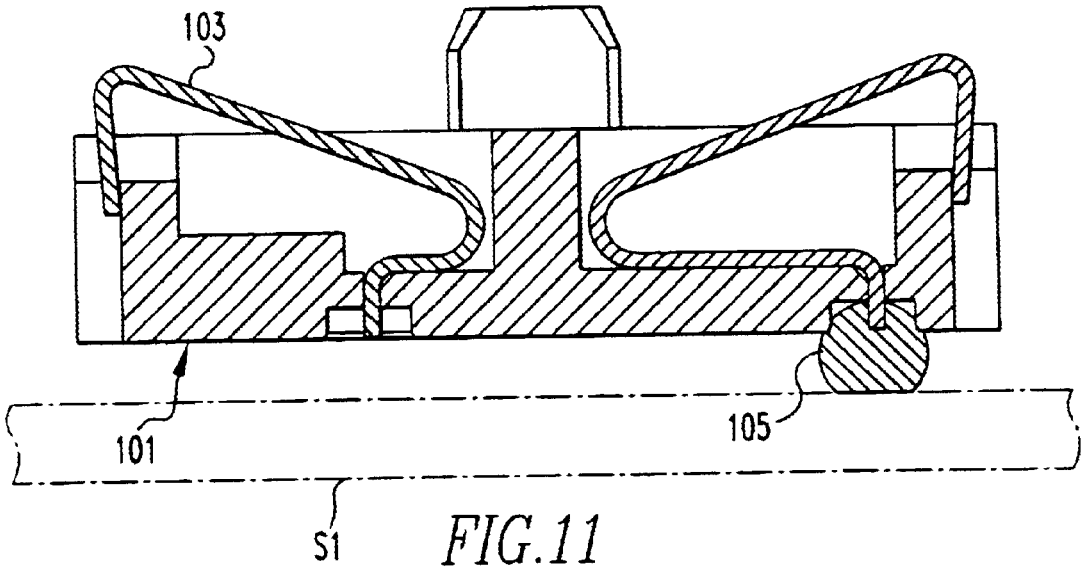
FIG. 11 is a cross-sectional view of the electrical connector, partially assembled, taken along lines XI—XI of FIG. 3.

FIG. 6 is a perspective view of a housing 101, FIG. 7 is a top view of the housing 101, and FIGS. 8, 9 and 10 are cross-sectional views of the housing 101 taken along lines VIII—VIII, IX—IX, and X—X, respectively, in FIG. 7. Housing 101 can be a suitable insulative material, such as a high temperature thermoplastic like liquid crystal polymer (LCP). Preferably, housing 101 is made by injection molding.

Housing 101 includes alignment posts 107, 109 to help position substrate S2 relative to connector 100. Housing 101 also has openings 111 through which contacts 103 extend. Each opening 111 can have retention features, such as projections 113 which engage contacts 103 by an interference fit. Projections 113 help retain contacts 103 within housing 101 until fusible elements 105 secure to contacts 103.

Housing 101 also includes a channel 115 for each contact 103. Channels 115 helps guide contact 103 when connector 100 mates with substrate S2. Specifically, as substrate S2 approaches and eventually engages connector 100, contacts 103 compress. During compression, channels 115 prevent undesired movement of contacts 103.

Openings 117 in the side wall of housing 101 communicate with corresponding channels 115. Openings 117 receive the distal end of contact 103. Due to the size of housing 101 and contact 103, openings 117 provide a preload to contacts 103. The preload helps ensure that contacts 103 provide adequate normal force when connector 100 mates with substrate S2.

If desired, connector 100 can surface mount to substrate S1. Preferably, connector 100 surface mounts using a fusible element 105, such as a solder ball. In order to assist the mounting of fusible element 105, housing 101 could have recesses 119 in communication with openings 111. Each recess 119 could receive a portion of a respective fusible element 105. One or more reflow steps could secure fusible element 105 to contact 103 and secure connector 101 to substrate S1. International Publication Number WO 98/15989, herein incorporated by reference, describes methods of securing a solder ball to a contact and to a substrate.

As seen in FIG. 3, recesses 119 are staggered on housing 101. Staggering fusible elements 105 helps connector 100 achieve a fine pitch (such as approximately 1 mm or less, for example).

Figure 13:
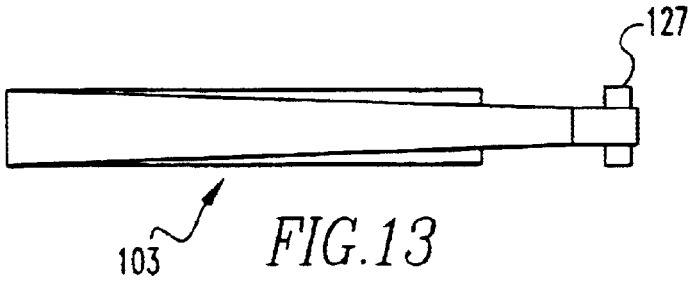
FIG. 13 is a top view of the contact shown in FIG. 12.
Figure 12:
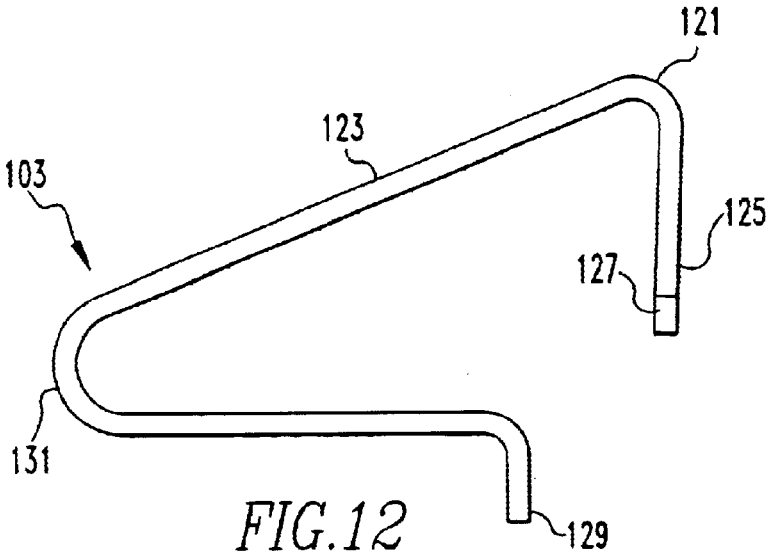
FIG. 12 is a side view of a contact, which is one component of the electrical connector shown in FIG. 1.
Figure 14:
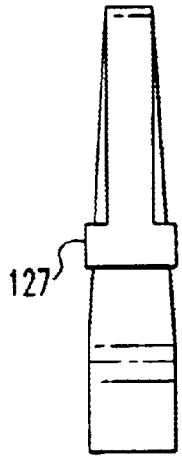
FIG. 14 is a front view of the contact shown in FIG. 12.

FIG. 12 is a side view of a contact 103, FIG. 13 is a top view of the contact 103, and FIG. 14 is a front view of the contact 103. Contact 103 is preferably stamped and formed from a suitable sheet of conductive material, such as copper alloy. In this embodiment, contact 103 has a compressive section with a mating area 121 flanked by an arm 123 and a tab 125. Arm 123 angularly deflects when connector mates with substrate S1. Tab 125 provides the preload to contact 103. Specifically, tab 125 has ears 127 extending therefrom. While the remainder of contact 103 can move through opening 117, ears 127 cannot. During insertion into housing 101, contact 103 must be compressed to insert tab 125 into opening 117. Upon complete insertion, however, ears 127 prevent contact 103 from returning to an unloaded state. In other words, contact 103 remains preloaded in housing 101.

Contact 103 also has an end opposite the compressive section. Contact 103 could have compressive sections at both ends. In the embodiment shown in the drawings, however, the end is a surface mount termination. Specifically, contact 103 has a mounting tab 129.

A bend 131 resides between mounting tab 129 and the compressive section. Bend 131 ensures adequate wiping action and provides the contact normal force to connector 100.

Figure 15:
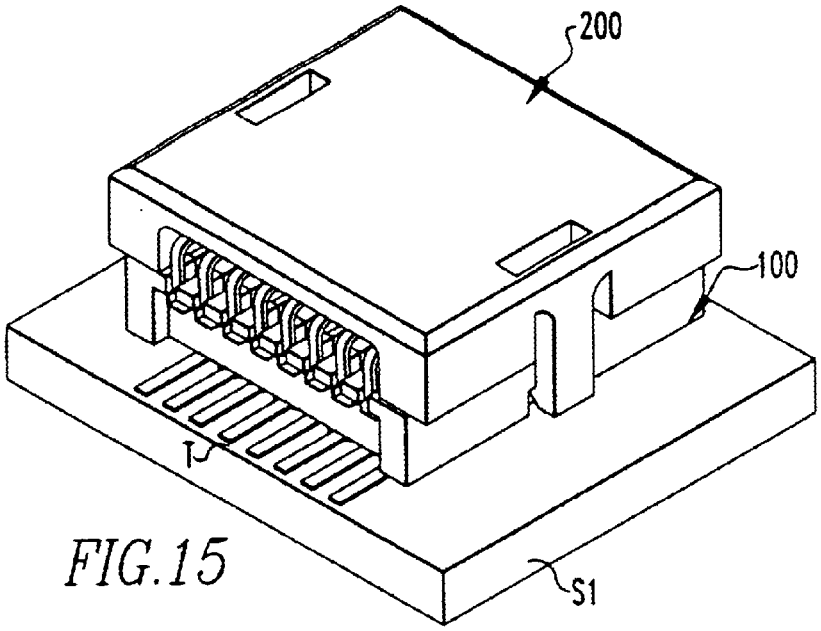
FIG. 15 is a perspective view of the electrical connector shown in FIG. 1, covered with a vacuum pickup cap, and placed upon a circuit substrate.
Figure 16:
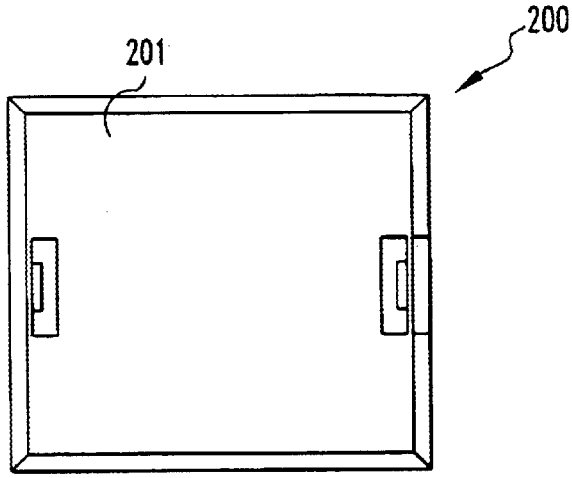
FIG. 16 is a top view of the vacuum pickup cap shown in FIG. 15.
Figure 17:
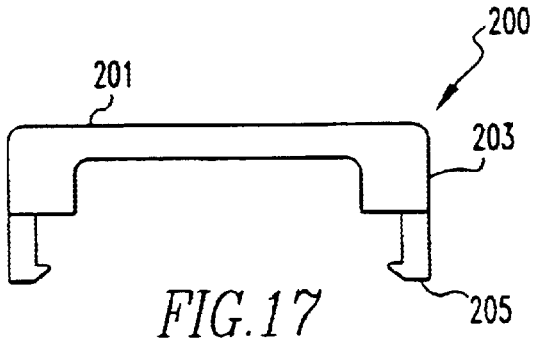
FIG. 17 is a side view of the vacuum pickup cap shown in FIG. 15.

FIG. 15 is a perspective view of the electrical connector shown 100 covered with a vacuum pickup cap 200, and placed upon a circuit substrate S1. FIG. 16 is a top view of the vacuum pickup cap 200 and FIG. 17 is a side view of the vacuum pickup cap 200. Cap 200 allows automated placement of connector 100 on substrate S1. Automated placement help ensure proper alignment of fusible elements 105 with a corresponding trace T on substrate S1.

Cap 200 has an upper wall 201 with side walls 203 extending therefrom. Side walls 203 can have latches 205 which engage suitable latch structure, such as notches 133 in housing 101. As seen in FIG. 15, side walls 203 rest on the upper face of housing 101. That way, cap 200 does not interfere with contacts 103.

Figure 18:
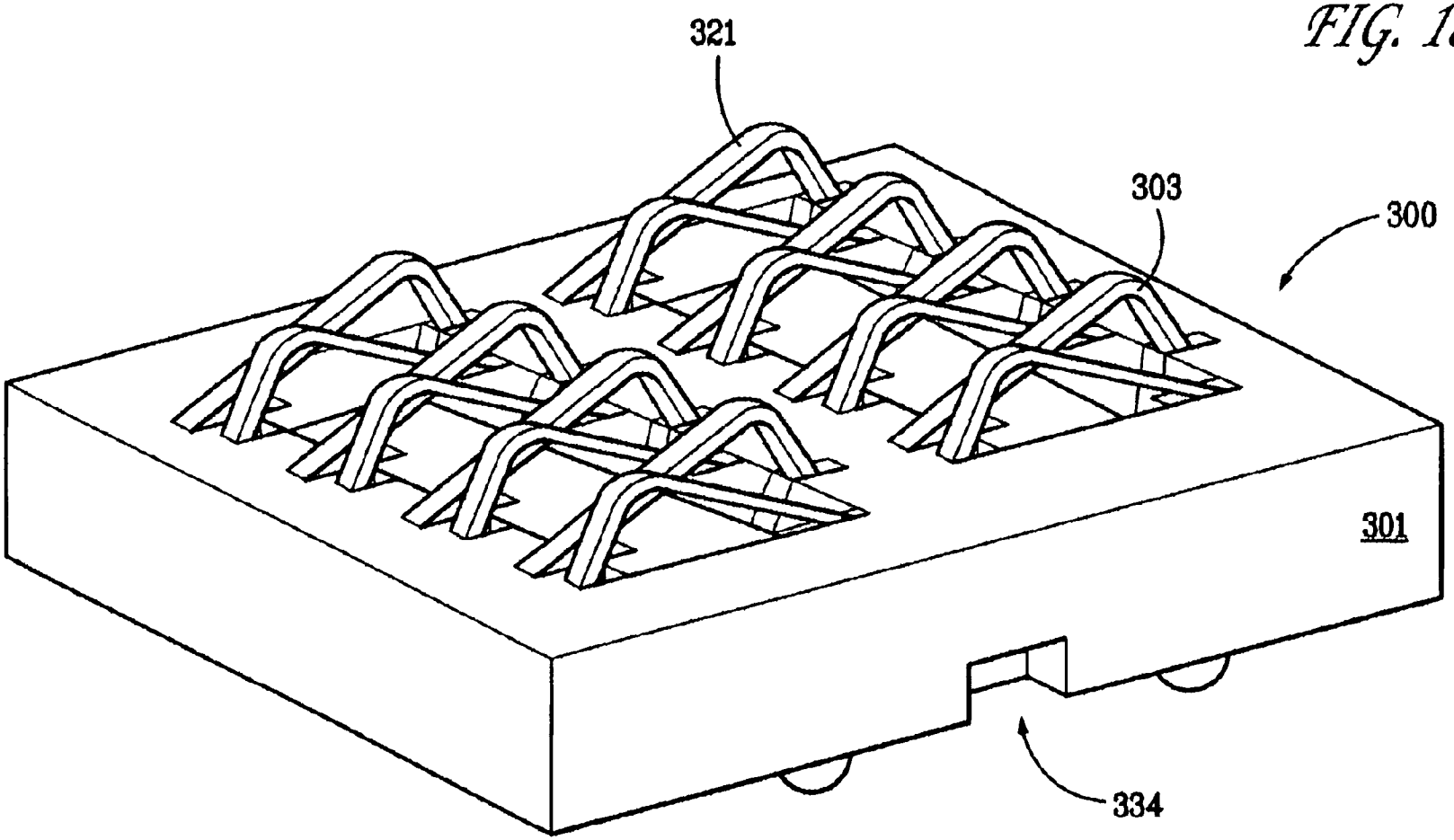
FIG. 18 is a perspective view of another alternative embodiment of an electrical connector of the present invention.
Figure 19:
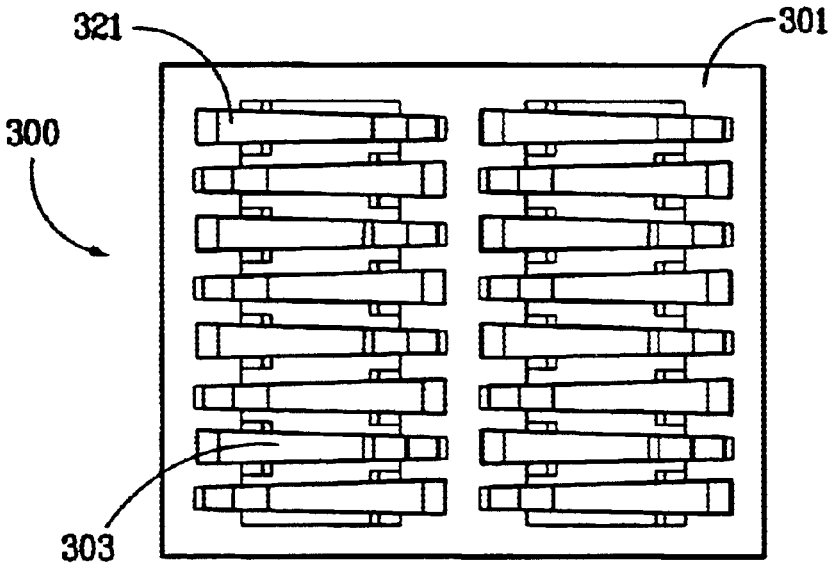
FIG. 19 is a top view of the electrical connector shown in FIG. 18.
Figure 20:
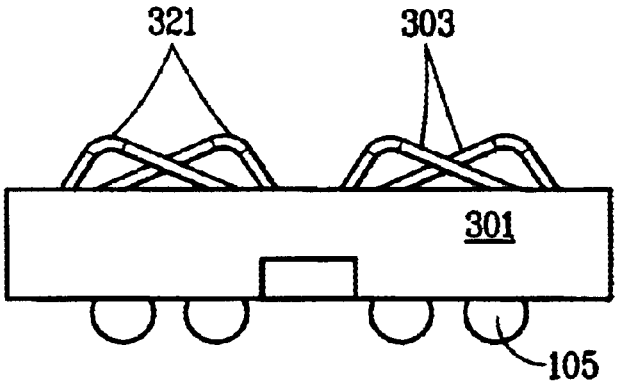
FIG. 20 is a side view of the electrical connector shown in FIG. 18 with fusible elements secured to associated contacts.
Figure 21:
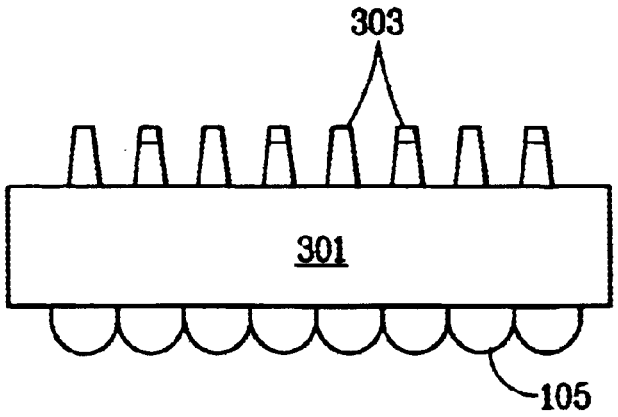
FIG. 21 is a front view of the electrical connector shown in FIG. 18 with fusible elements secured to all of the contacts.

FIG. 18 is a perspective view of another alternative embodiment of an electrical connector 300 of the present invention and FIG. 19 is a top view of the electrical connector 300. FIG. 20 is a side view of the electrical connector 300 with fusible elements 105 secured to associated contacts 303, and FIG. 21 is a front view of the electrical connector 300 with fusible elements 105 secured to all of the contacts 303. FIGS. 18–29 contain elements similar to those described above with respect to FIGS. 1–17. These elements are labeled identically and their description is omitted for brevity.

A difference between connector 300 and connector 100 is the number of rows of mating areas 321. Whereas connector 100 has two rows of mating areas 121, connector 300 has four rows of mating areas 321. More particularly, contacts 303 are placed front to back, so instead of two rows of top mating areas (e.g., mating areas 121), there are now four rows of top mating areas 321. Although two rows and four rows of contacts are described herein, it is contemplated that the connector of the present invention could have any number of rows of contacts.

Figure 22:
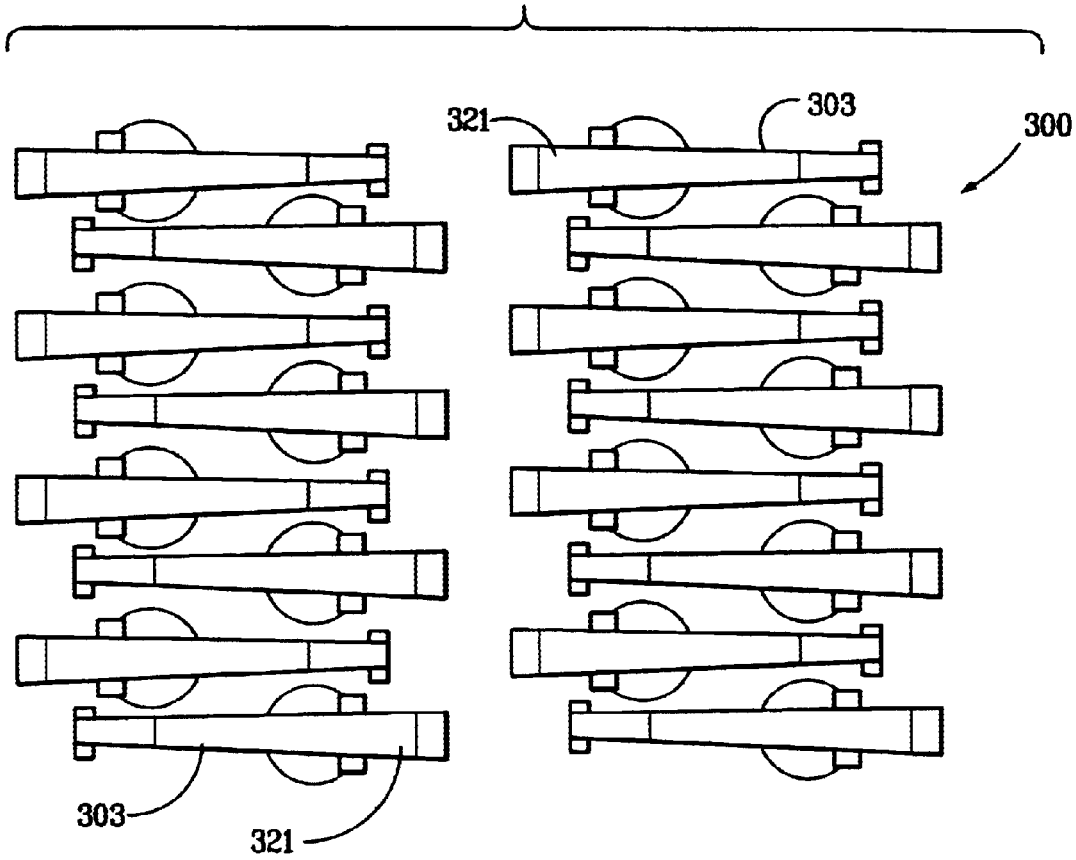
FIG. 22 is an enlarged top view of the connector shown in FIG. 18.
Figure 23:
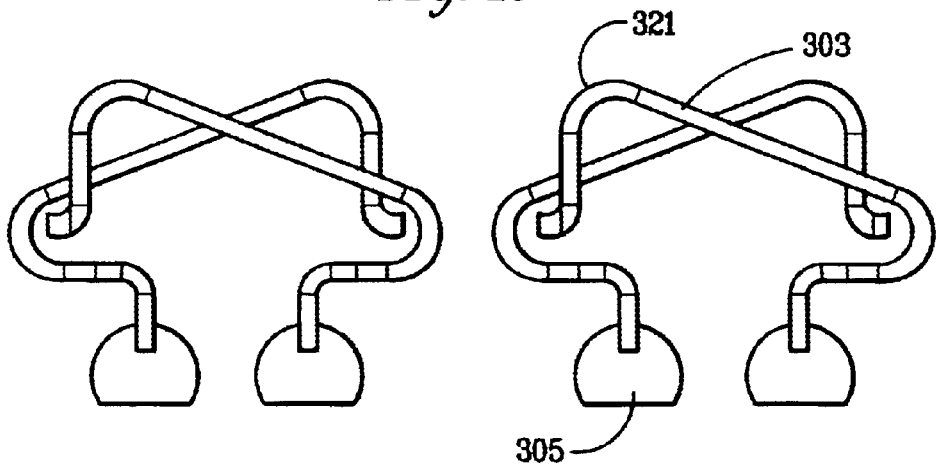
FIG. 23 is a side view of the electrical connector shown in FIG. 22.

FIG. 22 is a more detailed view of an exemplary electrical connector 300 in accordance with the present invention, and FIG. 23 is a corresponding side view. As shown, there are four rows of mating areas 321 of contacts 303. In this example, the contacts 303 are arranged so that the mating areas 321 of neighboring contacts are disposed at opposing ends. In other words, neighboring contacts are oriented in opposite directions. In this manner, each mating area 321 in a row of mating areas is separated from the next mating area 321 in that row by the end of a contact 303 that does not contain a mating area 321. This leads to a very compact connector.

Figure 24:
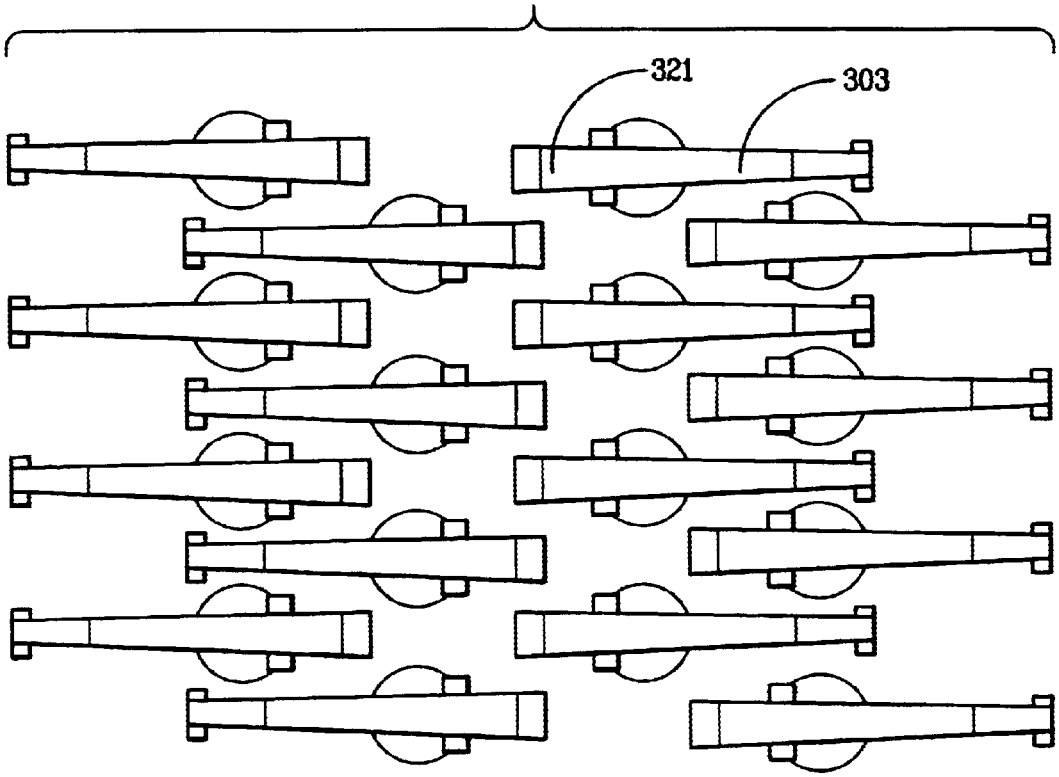
FIG. 24 is a top view of another exemplary electrical connector in accordance with the present invention.
Figure 25:
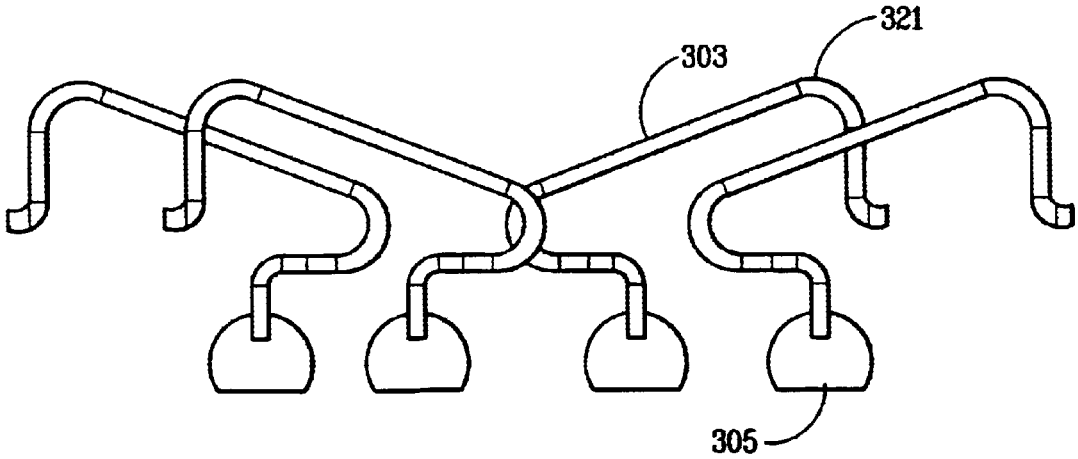
FIG. 25 is a side view of the electrical connector shown in FIG. 24.

The contacts 303 can be disposed in other arrangements, such as that shown in FIGS. 24 and 25, for example. In this embodiment, there are four rows of mating areas 321 of contacts 303. However, unlike the connector of FIG. 22, the contacts 303 are all oriented in the same direction, though they are in a similar staggered arrangement.

Another difference between connector 300 and connector 100 is the preloading of contacts 103, 303. In connector 100, openings 117 extend along an outside perimeter of housing 101 for receiving the tab 125 of contact 103. Because connector 300 has four rows, housing 301 must have a different arrangement. Accordingly, housing 301 includes an opening 333, as shown in FIG. 26, for each tab portion 325 of contact 303. Within opening 333, housing 301 has retentive features which engage the distal end and prevent contact 303 from returning to an unloaded condition after insertion into housing 301. For example, the retentive feature could be a shoulder within opening 333 that blocks the distal end.

In these embodiments, the contact pads are offset, as shown in FIGS. 22 and 26, for example. The top and bottom attachment locations are obtained by staggering and rotating contacts 180 degrees in an alternating manner. This offset allows for more side-to-side and front-to-back float, and a larger top circuit board pad to accommodate this float.

Moreover, in this embodiment, alignment posts (e.g., posts 107, 109) are not used. By removing the alignment posts, the potential for (1) the top circuit board alignment, (2) thermal stress or (3) mechanical stress being transferred from the top circuit board through the alignment posts and to the solder attachment is reduced. Removal of the posts also allows for housing size to be decreased.

FIG. 23 is a side view of a contact 303. The contact 303 uses a tapered cantilever beam for maximum deflection with uniform stress distribution. Like contact 103, contact 303 is preferably stamped and formed from a suitable sheet of conductive material, such as copper alloy. In this embodiment, contact 303 has a compressive section with a mating area 321 flanked by an arm 323 and a tab 325. Tab 325 provides the preload to contact 303, and has a projection 327 extending therefrom. Arm 323 angularly deflects when connector mates with substrate S1.

Contact 303 also has an end opposite the compressive section. Contact 303 could have compressive sections at both ends. In the embodiment shown in the drawings, however, the end is a surface mount termination. Specifically, contact 303 has a mounting tab 329.

During insertion into housing 301, contacts 303 must be compressed to insert tab 325 into opening 333. Upon complete insertion, projection 327 prevents contact 303 from returning to an unloaded state. In other words, contact 303 remains preloaded in housing 301.

A bend 331 resides between mounting tab 329 and the compressive section. Bend 331 ensures adequate wiping action and provides the contact normal force to connector 300.

Preferably, all contacts are assembled from the top and use standard solder ball attachment process. The solder ball recess 319 has been modified so that the rear contact surface rests on a flat surface and the front contact surface interferes with the housing bump. This allows for more consistent contact positioning because the bump only compresses on one side instead of both sides.

Figure 28:
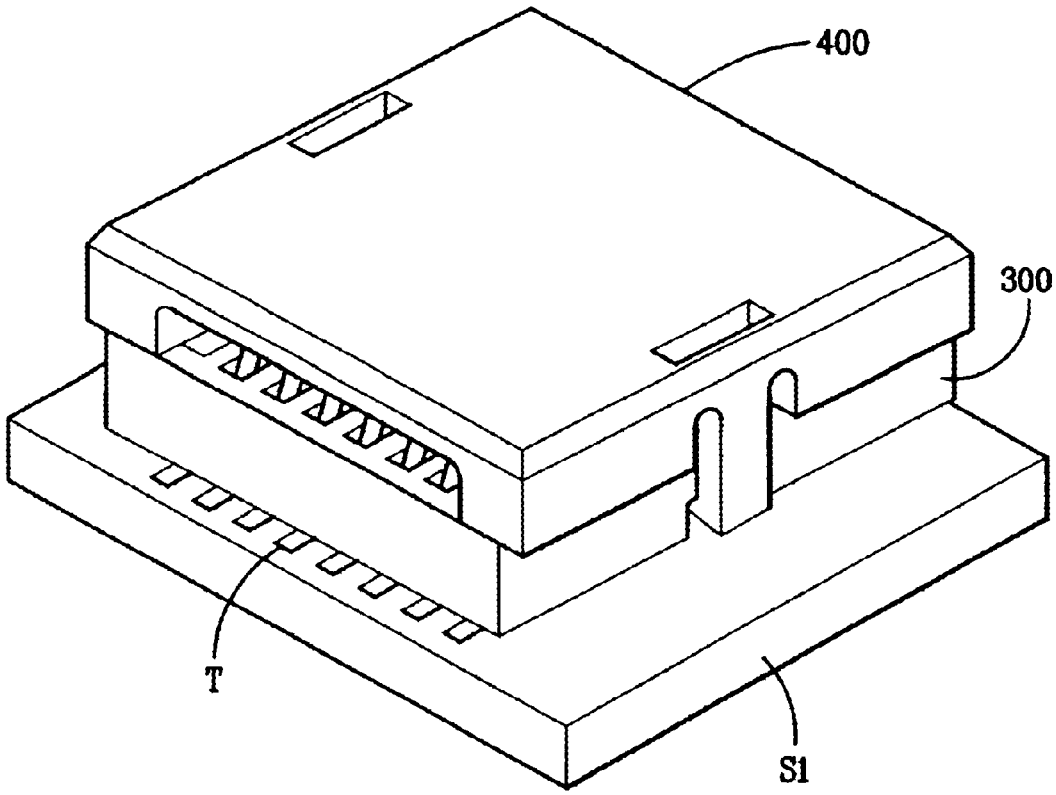
FIG. 28 is a perspective view of the electrical connector shown in FIG. 18, covered with a vacuum pickup cap, and placed upon a circuit substrate.
Figure 29:
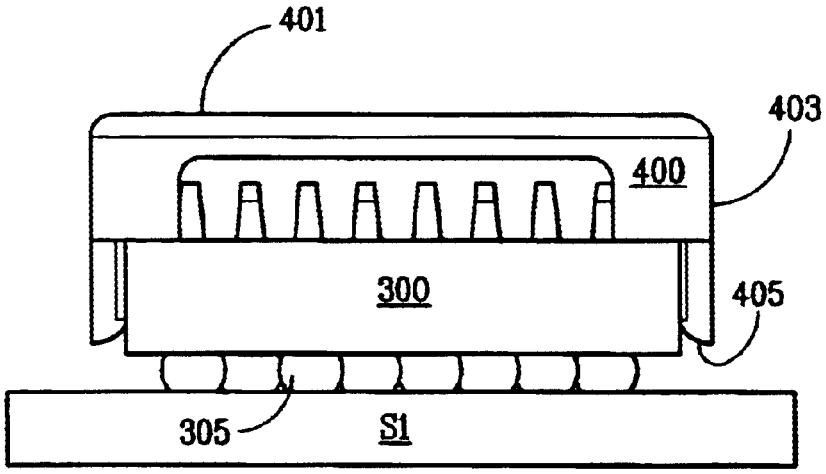
FIG. 29 is a side view of the electrical connector, cap, and substrate of FIG. 28.

FIG. 28 is a perspective view of the electrical connector 300, covered with a vacuum pickup cap 400, and placed upon a circuit substrate S1, and FIG. 29 is a side view of the electrical connector 300, cap 400, and substrate S1. Similar to cap 200, cap 400 allows automated placement of connector 300 on substrate S1. Automated placement helps ensure proper alignment of fusible elements 305 with a corresponding trace T on substrate S1.

Cap 400 has an upper wall 401 with side walls 403 extending therefrom. Side walls 403 can have latches 405 which engage suitable latch structure, such as notches 334 in housing 301. As seen in FIG. 29, side walls 403 rest on the upper face of housing 301. That way, cap 400 does not interfere with contacts 303.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector, comprising:

a housing having a retention structure, the retention structure including a channel extending substantially in a first direction, a recess, and an opening formed therein and extending between the channel and the recess; and a contact mounted in the channel and comprising:

a medial section;

a mounting portion extending from one end of the medial section and comprising a mounting tab, the mounting tab extending through the opening and contacting the housing so that the housing restrains the contact in the first direction and in a second direction substantially opposite the first direction; and a compressive mating portion extending from another end of said medial section and having a distal end, wherein the retention structure of said housing engages the distal end of the compressive mating portion of the contact to preload the contact.

2. The electrical connector of claim 1, further comprising a fusible element secured to the mounting portion of the contact.

3. The electrical connector of claim 2, wherein the fusible element is positioned at least in part within the recess.

4. The electrical connector of claim 2, wherein the housing comprises a projection located within the opening and securely engaging the mounting tab.

* * * * *